US009073322B1

(12) United States Patent
Nystrom et al.

(10) Patent No.: US 9,073,322 B1
(45) Date of Patent: Jul. 7, 2015

(54) ELECTROSTATIC DEVICE IMPROVED MEMBRANE BONDING

(71) Applicant: XEROX CORPORATION, Norwalk, CT (US)

(72) Inventors: Peter J. Nystrom, Webster, NY (US); Gary D. Redding, Victor, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/211,520

(22) Filed: Mar. 14, 2014

(51) Int. Cl.
*B41J 2/06* (2006.01)
*B41J 2/14* (2006.01)
*B41J 2/16* (2006.01)

(52) U.S. Cl.
CPC ..... *B41J 2/14314* (2013.01); *B41J 2/16* (2013.01); *B41J 2/1623* (2013.01); *B41J 2/1626* (2013.01); *B41J 2/164* (2013.01)

(58) Field of Classification Search
CPC ..... B41J 2/1623; B41J 2/14314; B41J 2002/043; B41J 2/14233
USPC ..... 347/40–44, 48–49, 55, 69, 112
See application file for complete search history.

(56) References Cited

U.S. PATENT DOCUMENTS

| | | | | |
|---|---|---|---|---|
| 5,214,307 | A | 5/1993 | Davis | |
| 7,980,671 | B2 * | 7/2011 | Nystrom et al. | 347/55 |
| 2006/0082257 | A1 * | 4/2006 | Bibl et al. | 310/334 |

* cited by examiner

*Primary Examiner* — Thinh Nguyen
(74) *Attorney, Agent, or Firm* — MH2 Technology Law Group LLP

(57) ABSTRACT

An electrostatic actuator array including a plurality of recesses within an actuator membrane and a method for forming same. In an embodiment, a width of each recess is wider than a width of each bonding feature of a plurality of bonding features, and each bonding feature extends into one of the recesses. In another embodiment, a width of each recess is narrower than a width of each bonding feature. In each embodiment, adhesive within the recesses bonds the membrane to the bonding feature. The recesses provide a flow path for the adhesive to reduce or prevent adhesive encroachment into an air chamber within which an actuator electrode is located.

20 Claims, 3 Drawing Sheets

ELECTROSTATIC DEVICE IMPROVED MEMBRANE BONDING

TECHNICAL FIELD

The present teachings relate to the field of ink jet printing devices and, more particularly, to methods and structures for high density electrostatic ink jet print heads and a printer including a high density electrostatic ink jet print head.

BACKGROUND

Drop on demand ink jet technology is widely used in the printing industry. Printers using drop on demand ink jet technology may use a plurality of electrostatic actuators, piezoelectric actuators, or thermal actuators to eject ink from a plurality of nozzles in an aperture plate. In electrostatic ejection, each electrostatic actuator, which is formed on a substrate assembly, typically includes a flexible diaphragm or membrane, an ink chamber between the aperture plate and the membrane, and an air chamber between the actuator membrane and the substrate assembly. An electrostatic actuator further includes an actuator electrode (i.e., drive electrode) formed on the substrate assembly. When a voltage is applied to activate the actuator electrode, the membrane is drawn toward the electrode by an electric field and actuates from a relaxed state to a flexed state, which increases a volume of the ink chamber and draws ink into the ink chamber from an ink supply or reservoir. When the voltage is removed to deactivate the actuator electrode, the membrane relaxes, the volume within the ink chamber decreases, and ink is ejected from the nozzle in the aperture plate.

One critical aspect of electrostatic actuators is the dimensions of a spacing or gap between the actuator electrode and the membrane. The gap affects both the volume of ink ejected from a nozzle upon removal of the voltage from the actuator electrode and the voltage that must be applied to the actuator electrode to sufficiently deflect the membrane to eject ink from a printhead nozzle. A gap that is too narrow or too wide will eject either an insufficient or excessive quantity of ink respectively. Further, as the gap height increases, the power that must be applied to the actuator electrode to sufficiently deflect the membrane also increases.

An electrostatic actuator further includes a dielectric gap standoff layer formed on portions of the conductive layer that is used to form the actuator electrodes. The membrane is adhered or bonded to an upper surface of the gap standoff layer with an adhesive to space the membrane from the electrode; thus a thickness of the gap standoff layer partially determines the gap between the actuator electrode and the membrane. The gap height is also affected by the technique used to bond the membrane to the gap standoff. An adhesive layer, for example EPON™ available from Miller-Stephenson Chemical Co. of Danbury, Conn., a liquid resin, a solder, or another flowable adhesive may be interposed between the gap standoff and the membrane, and then cured during the application of heat and pressure to bond the actuator membrane to the gap standoff. This process, however, is prone to contamination of the actuator air chamber (i.e., the electrostatic gap) with stray adhesive which may encroach or "squeeze out" into the actuator air chamber during the bonding of the membrane to the gap standoff under the application of heat and pressure. Excessive adhesive may negatively affect device performance, for example, if the adhesive encroaches between the membrane and the electrode. Some variation in the quantity of liquid adhesive dispensed onto the actuator membrane and/or gap standoff prior to assembly is unavoidable, and negative effects from adhesive squeeze out becomes more problematic as an excess of adhesive is applied. Further, processing variation may affect the accuracy of the final adhesive thickness and contributes to variation in the gap height away from a target height.

A method for forming an electrostatically actuated ink jet printhead that overcomes problems associated with some other formation methods, and the resulting printhead, would be desirable.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

An embodiment of the present teachings includes an electrostatic actuator array comprising a plurality of electrostatic actuators, wherein each electrostatic actuator includes a substrate assembly, an actuator membrane overlying the substrate assembly, an actuator electrode spaced from the electrostatic actuator membrane by an actuator air chamber and configured to attract and deflect the actuator membrane, a gap standoff layer that supports the actuator membrane and spaces the actuator membrane from the actuator electrode, at least one recess within a surface of the actuator membrane, and an adhesive layer located within the at least one recess, wherein the adhesive layer is interposed between the gap standoff layer and the actuator membrane and bonds the actuator membrane to the gap standoff layer.

Another embodiment of the present teachings includes a method for forming a printhead having an electrostatic actuator array including a plurality of electrostatic actuators formed using a method including forming an actuator electrode over a substrate assembly, forming a gap standoff layer over the substrate assembly, forming an actuator membrane comprising at least one recess therein, dispensing an adhesive onto at least one of the actuator membrane and the gap standoff layer, and bonding the actuator membrane to the gap standoff layer with the adhesive to form an actuator air chamber that spaces the actuator membrane from the actuator electrode wherein, subsequent to the attachment, the adhesive resides within the at least one recess, and the actuator electrode is configured to attract and deflect the actuator membrane.

Another embodiment of the present teachings includes a printer having a printhead with an electrostatic actuator array having a plurality of electrostatic actuators, wherein each electrostatic actuator includes a substrate assembly, an actuator membrane overlying the substrate assembly, an actuator electrode spaced from the electrostatic actuator membrane by an actuator air chamber and configured to attract and deflect the actuator membrane, a gap standoff layer that supports the actuator membrane and spaces the actuator membrane from the actuator electrode, at least one recess within a surface of the actuator membrane, and an adhesive layer located within the at least one recess, wherein the adhesive layer is interposed between the gap standoff layer and the actuator membrane and bonds the actuator membrane to the gap standoff layer. The printer may further include a housing that encases the printhead.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. have been simplified and are drawn to facilitate understanding of the present teachings rather than to maintain strict structural accuracy, detail, and scale.

DETAILED DESCRIPTION

Reference will now be made in detail to exemplary embodiments of the present teachings, examples of which are illustrated in the accompanying drawings. Wherever possible, the same reference numbers will be used throughout the drawings to refer to the same or like parts.

As used herein, unless otherwise specified, the word "printer" encompasses any apparatus that performs a print outputting function for any purpose, such as a digital copier, bookmaking machine, facsimile machine, a multi-function machine, electrostatographic device, etc.

Successfully controlling an adhesive bond line during attachment of a foil membrane to an actuator standoff reduces or prevents the encroachment of adhesive into the actuator air chamber, particularly into the gap that spaces the membrane from the actuator electrode. However, adhesive squeeze out is difficult to prevent since some variation in the quantity of liquid adhesive dispensed during attachment of the actuator membrane to the gap standoff is unavoidable. A small amount of lateral intrusion of adhesive into the actuator air chamber is tolerable but, a much greater volume will begin to negatively impact the device performance particularly since the gap between the bottom of the membrane and the top of the drive electrode is very small, on the order of 1.0 micrometer (μm) or less, and may be as small as 0.18 μm or less. Since the applied coating of adhesive is already very thin, it is difficult to apply even less. Applying too little adhesive results in poor membrane adhesion and reduced device performance. An embodiment of the present teachings may result in a device that has improved adhesive bond line control and resistance to performance issues resulting from excessive adhesive during attachment of an actuator membrane to a plurality of gap standoffs.

Figure 1:
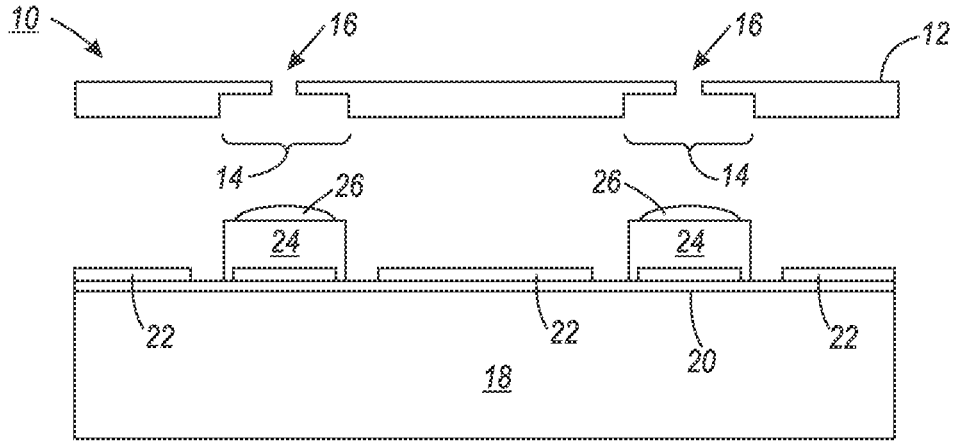
FIGS. 1 and 2 are cross sections depicting in-process structures that may be formed using an embodiment of the present teachings.
Figure 2:
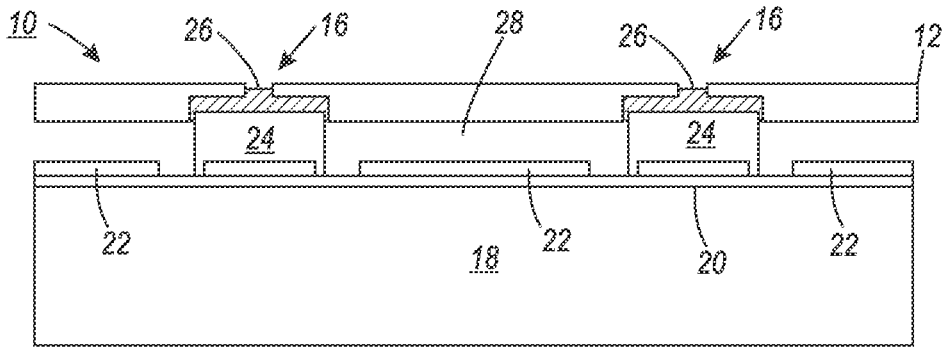

In-process structures which can be formed during an embodiment of the present teachings are depicted in FIGS. 1 and 2. FIG. 1 depicts a portion of an electrostatic printhead structure 10 including a plurality of electrostatic actuators (i.e., transducers) prior to assembly. The actuator array of the FIG. 1 structure 10 includes a membrane or diaphragm 12 having a plurality of recesses 14 that extend partially through the membrane 12 and, optionally, a plurality of membrane holes or openings 16. If present, each of the plurality of holes 16 extend completely through the actuator membrane 12 from a first side of the membrane to a second side of the membrane that is opposite the first side. In this embodiment, each recess 14 includes one of the holes 16, where the hole has a width or diameter than is smaller than the width of the recess. The recesses 14 and holes 16 in the membrane 12 may be formed by any suitable technique, for example wet or dry chemical etching of metal, nickel electroforms, embossed metal foil, etched thin silicon, etched silicon-on-insulator (SOI) wafers, metalized quartz, etc.

In this embodiment, each recess 14 has a width that is wider than the width of each portion of the gap standoff layer 24. In an embodiment, each portion of the gap standoff layer 24 may have a width of between about 5 μm and about 250 μm, or between about 25 μm and about 125 μm, or between about 70 μm and about 80 μm, for example about 75 μm. Each recess 14 in the membrane 12 may have a width that is between about 1 μm and about 100 μm larger than the width of each portion of the gap standoff layer. FIG. 1 further depicts a substrate assembly 18, for example a semiconductor substrate assembly, a dielectric layer 20 formed on the substrate assembly 18, and a plurality of electrodes 22 on the dielectric layer 20 which are formed from a conductive electrode layer. The membrane 12 overlies the substrate assembly 18. A smaller difference between a width of each recess 14 and each portion of the gap standoff layer 24 will better align the membrane 12 with the electrodes 22, but requires a tighter feature tolerance. A gap standoff layer 24 is formed over the substrate assembly 18, and may be formed on a portion of the conductive electrode layer as depicted. While FIG. 1 depicts two separate gap standoffs 24 that provide individual bonding features, it will be understood that the gap standoffs 24 may be part of a continuous grid or matrix which appears separate in cross section. Further, while FIG. 1 depicts one complete and two partial electrodes 22, a printhead may include hundreds or thousands of electrodes 22.

FIG. 1 further depicts a liquid adhesive layer 26 dispensed onto the gap standoff layer 24 which instead may be dispensed into the recesses 14 in the membrane 12 in an alternate embodiment.

Subsequently, the recesses 14 within the membrane 12 are aligned with the gap standoff layer 24 and the membrane 12 is brought into contact with the adhesive 26 as depicted in FIG. 2. The adhesive 26 is then cured to secure the membrane 12 to the gap standoff layer 24. Curing of the adhesive 26 may include the application of controlled heat and pressure between the membrane 12 and the gap standoff layer 24, for example in a press (not depicted for simplicity). As the membrane 12 and gap standoff layer 24 are brought together, which provides an actuator air chamber 28, the adhesive 26 flows into the gap between the membrane 12 and the gap standoff layer 24. Including the recess 14 in the membrane 12 provides a space for any excess adhesive to flow without encroaching into the actuator air chamber 28. A flow path for the adhesive 26 includes the upper surface and a portion of the sides of the gap standoff layer 24. In a conventional device, the lower surface of the membrane 12 is planar and an adhesive will laterally encroach more easily into the actuator air chamber 28 compared to the printhead device design described herein, wherein the membrane has a non-planar surface that includes at least one recess within the actuator membrane, where the adhesive is located within the recess.

Reducing or preventing adhesive encroachment into the air chamber 28 becomes increasingly important with smaller devices. An actuator air chamber 28 may have a width of about 600 μm for a 600 dpi device to as small as 100 μm to 300 μm, or smaller than 100 μm, for a 240 dpi device. These devices have a very thin gap with the membrane supported over the electrodes 22, similar to that of a drum head. Typical membrane thicknesses may range from about 10 μm to about 20 um for these geometries, but can be even thinner for long narrow devices. Target deflection of this membrane 12 during ejection of ink from the printhead may be between 0.1 μm to 0.2 μm, or another suitable deflection target, to achieve the desired drop size and velocity. Thus any lateral encroachment of adhesive between the membrane 12 and the electrode 22 may impede membrane deflection, jet efficiency, and ink ejection from a printhead nozzle (not individually depicted for simplicity).

Figure 3:
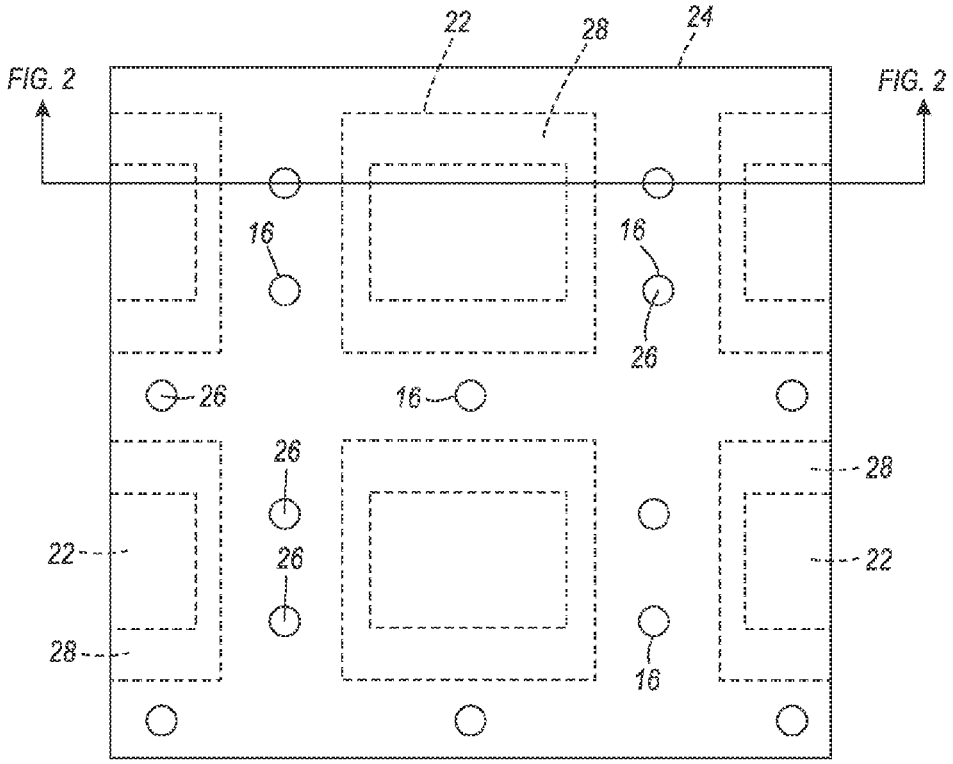
FIG. 3 is a plan view of the FIG. 2 structure.

The membrane holes or openings 16 completely through the membrane 12 are optionally provided, depending on the printhead device design. If membrane openings 16 are provided within the membrane 12, the adhesive flow path may also include the membrane openings 16. Additionally, the membrane openings 16 provide a window for the alignment of the membrane 12 with the gap standoff layer 24 during assembly. In an embodiment, the membrane 12 may be moved in the X- and Y-directions until the membrane openings 16, and therefore the membrane 12, are in vertical alignment with the gap standoff 24. Automatic alignment may be performed using an optical alignment system that may include a camera system (not individually depicted for simplicity), or the alignment may be performed manually. FIG. 3 depicts a plan view of the FIG. 2 structure. It will be understood that the depictions presented herein are schematic representations and that printheads may include other structures which have not been depicted for simplicity and that depicted structures may be removed or modified.

In this embodiment, the height of the dielectric gap standoff layer 24 is increased by an amount equal to the depth of the recesses 14 within the membrane 12 so that the distance between the lower surface of the membrane 12 and the top of each electrode 22 is correct. In other words, compared to a conventional printhead having a membrane with a planar lower surface, the gap standoff layer 24 of the device of the present embodiment is taller by an amount equal to a depth of the recesses 14.

Figure 4:
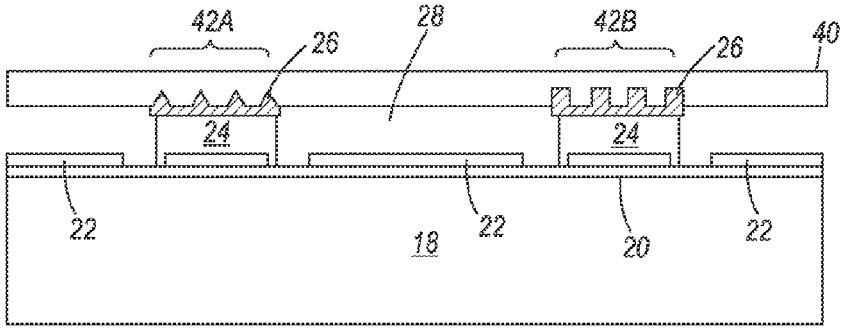
FIG. 4 is a schematic cross section depicting two embodiments of the present teachings.

FIG. 4 depicts a printhead that includes a membrane 40 including a plurality of recesses 42 that receive adhesive but, unlike the embodiment of FIG. 2, it is not necessary to increase the height of the gap standoff layer 24 compared to a conventional device design. In this embodiment, the one or more recesses 42 each have a width that is narrower than a width of each portion of the gap standoff layer 24. The recesses 40 may be formed to have any desired shape, such as triangular 40A, square or rectangular 40B, semicircular (not depicted for simplicity), or any other desired shape, where the width is less than a width of the gap standoff layer 24. The plurality of recesses are interposed between the gap standoff layer 24 and the membrane 40. While FIG. 4 depicts both triangular 42A and square 42B recesses 42 for simplicity of explanation, a typical device will only have one recess shape, although multiple shapes are contemplated.

The recesses 42 in membrane 40 may be formed by any suitable technique, for example wet or dry chemical etching or roughening of metal, grit blasting, embossing or nano-indenting/nano-coining using a punch or stamp, laser roughening or ablation, etc. In the embodiments of FIGS. 2 and 4, the recesses 14, 42 are formed only between the membrane 12, 40 and the gap standoff layer 24 and thus will not affect the electrical (capacitive) interaction between the membrane 12, 40, and the drive electrode 22. The process of FIG. 4 may be more compatible with existing designs than the process of FIG. 2, for example because the height of the gap standoff layer 24 does not need to be modified to offset the depth of a recess. In an embodiment, the recesses 42 may be formed with a tool such as a punch or stamp and may have a maximum width of between about 10 nanometers (nm) and about 5 μm, or a width of between about 100 nm and about 2 μm. In another embodiment, the recesses 42 may be formed by etching and may have a maximum width of between about 1 μm and about 10 μm. The height of each recess 42 may be about equal to its width.

Figure 5:
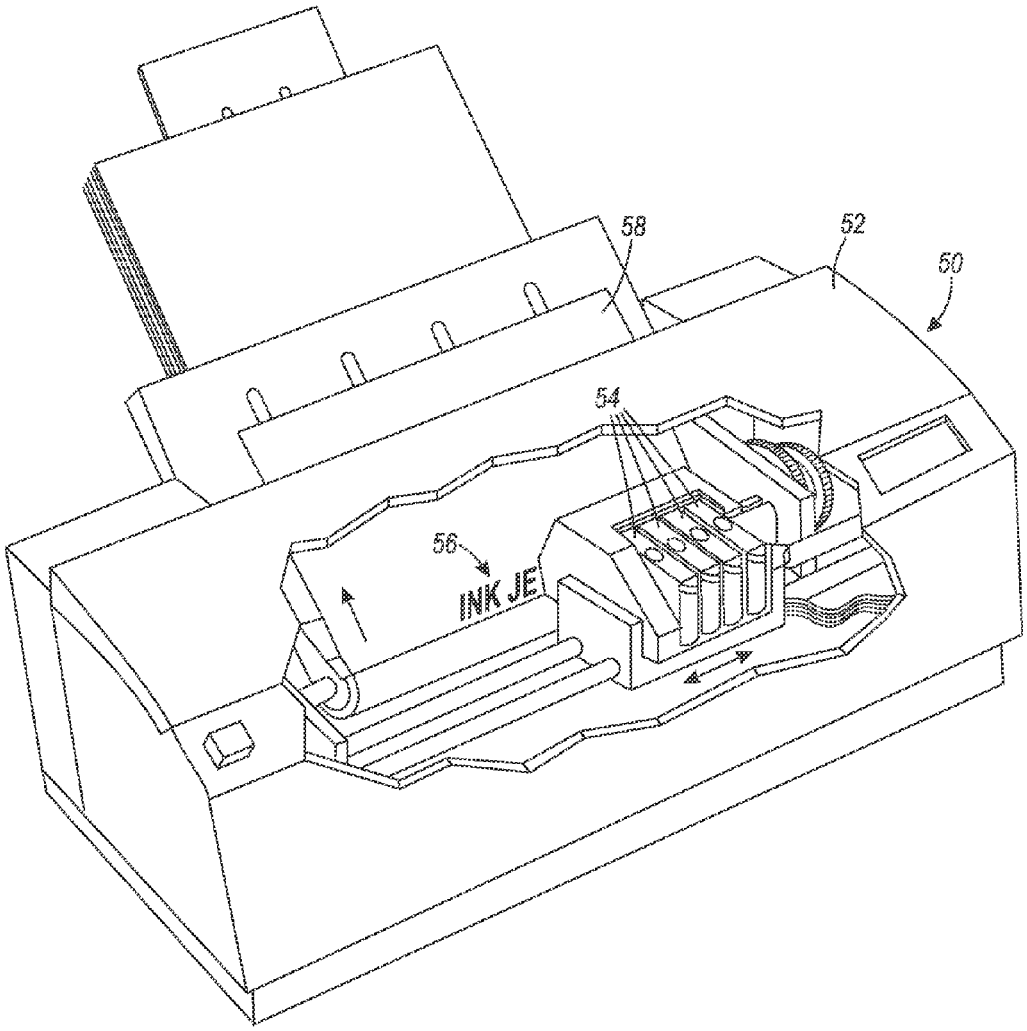
FIG. 5 is a schematic perspective depiction of a printer including one or more printheads formed in accordance with an embodiment of the present teachings.

FIG. 5 depicts a printer 50 including a printer housing 52 into which at least one printhead 54 including an embodiment of the present teachings has been installed. The housing 52 may encase the printhead 54. During a printing operation, ink 56 is ejected from one or more printheads 54. The printhead 54 is operated in accordance with digital instructions to create a desired image on a print medium 58 such as a paper sheet, plastic, etc. The printhead 54 may move back and forth relative to the print medium 58 in a scanning motion to generate the printed image swath by swath. Alternately, the printhead 54 may be held fixed and the print medium 58 moved relative to it, creating an image as wide as the printhead 54 in a single pass. The printhead 54 can be narrower than, or as wide as, the print medium 58. In another embodiment, the printhead 54 can print to an intermediate surface such as a rotating drum or belt (not depicted for simplicity) for subsequent transfer to a print medium.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. An electrostatic actuator array comprising a plurality of electrostatic actuators, wherein each electrostatic actuator comprises:

a substrate assembly;

an actuator membrane overlying the substrate assembly;

an actuator electrode spaced from the electrostatic actuator membrane by an actuator air chamber and configured to attract and deflect the actuator membrane;

a gap standoff layer that supports the actuator membrane and spaces the actuator membrane from the actuator electrode;

at least one recess within a surface of the actuator membrane; and an adhesive layer located within the at least one recess, wherein the adhesive layer is interposed between the gap standoff layer and the actuator membrane and bonds the actuator membrane to the gap standoff layer.

2. The electrostatic actuator array of claim 1, wherein:

the gap standoff layer comprises a plurality of bonding features, wherein each bonding feature has a first width;

the surface of the actuator membrane comprises a plurality of recesses each having a second width that is wider than the first width;

each bonding feature extends into one of the recesses within the surface of the actuator membrane; and the adhesive is located within the plurality of recesses.

3. The electrostatic actuator array of claim 2, wherein the first width is between 5 μm and 250 μm and the second width is between 1 μm and 100 μm larger than the first width.

4. The electrostatic actuator array of claim 1, wherein:

the gap standoff layer comprises a plurality of bonding features, wherein each bonding feature has a first width;

the surface of the actuator membrane comprises a plurality of recesses each having a second width that is narrower than the first width;

the plurality of recesses overlie one of the bonding features; and the adhesive is located within the plurality of recesses.

5. The electrostatic actuator array of claim 4, wherein each of the plurality of recesses, in cross section, comprises a triangular shape.

6. The electrostatic actuator array of claim 4, wherein each of the plurality of recesses, in cross section, comprises a square or rectangular shape.

7. The electrostatic actuator array of claim 1, wherein the electrostatic actuator array is part of an ink jet printhead.

8. The electrostatic actuator array of claim 1, wherein:

the gap standoff layer comprises a plurality of bonding features, wherein each bonding feature has a first width;

the surface of the actuator membrane comprises a plurality of recesses each having a second width that is wider than the first width;

each bonding feature extends into one of the recesses within the surface of the actuator membrane;

a plurality of holes that extend completely through the actuator membrane, wherein each of the plurality of recesses further comprises one of the holes; and the adhesive is located within the plurality of recesses and within the plurality of holes.

9. A method for forming a printhead comprising an electrostatic actuator array comprising a plurality of electrostatic actuators, comprising:

forming an actuator electrode over a substrate assembly;

forming a gap standoff layer over the substrate assembly;

forming an actuator membrane comprising at least one recess therein;

dispensing an adhesive onto at least one of the actuator membrane and the gap standoff layer; and bonding the actuator membrane to the gap standoff layer with the adhesive to form an actuator air chamber that spaces the actuator membrane from the actuator electrode wherein, subsequent to the attachment, the adhesive resides within the at least one recess, and the actuator electrode is configured to attract and deflect the actuator membrane.

10. The method of claim 9, further comprising:

etching the gap standoff layer to form a plurality of bonding features, wherein each bonding feature has a first width;

etching the surface of the actuator membrane to form a plurality of recesses therein, wherein each having a second width that is wider than the first width;

interposing the adhesive between each of the plurality of recesses within the surface of the actuator membrane and the plurality of bonding features; and placing each bonding feature into one of the recesses within the surface of the actuator membrane wherein, subsequent to placing each bonding feature into one of the recesses, the adhesive is located within the plurality of recesses.

11. The method of claim 10, wherein:

the etching of the gap standoff layer forms the plurality of bonding features to have a first width of between 5 μm and 250 μm; and the etching of the plurality of recesses forms the plurality of recesses to each have a second width that is between 1 μm and 100 μm larger than the first width.

12. The method of claim 9, further comprising:

the etching of the gap standoff layer forms each the plurality of bonding features to have a first width;

the etching of the plurality of recesses forms the plurality of recess to have a second width that is narrower than the first width; and bonding the gap standoff layer to the actuator membrane places the plurality of recesses to overlie one of the bonding features wherein, subsequent to bonding the gap standoff layer to the actuator membrane, the adhesive resides within the plurality of recesses.

13. The method of claim 12, wherein the etching of the plurality of recesses forms the plurality of recesses to comprise, in cross section, triangular shape.

14. The method of claim 12, wherein the etching of the plurality of recess forms the plurality of recesses to comprise, in cross section, comprises a square or rectangular shape.

15. The method of claim 9, further comprising:

the etching of the gap standoff layer forms each the plurality of bonding features to have a first width;

the etching of the plurality of recesses forms the plurality of recess to have a second width that is narrower than the first width;

etching a plurality of holes that extend completely through the actuator membrane, wherein each of the plurality of recesses further comprises one of the holes; and bonding the gap standoff layer to the actuator membrane places the plurality of recesses to overlie one of the bonding features wherein, subsequent to bonding the gap standoff layer to the actuator membrane, the adhesive resides within the plurality of recesses.

16. A printer, comprising:

a printhead comprising an electrostatic actuator array having a plurality of electrostatic actuators, wherein each electrostatic actuator comprises:

a substrate assembly;

an actuator membrane overlying the substrate assembly;

an actuator electrode spaced from the electrostatic actuator membrane by an actuator air chamber and configured to attract and deflect the actuator membrane;

a gap standoff layer that supports the actuator membrane and spaces the actuator membrane from the actuator electrode;

at least one recess within a surface of the actuator membrane; and an adhesive layer located within the at least one recess, wherein the adhesive layer is interposed between the gap standoff layer and the actuator membrane and bonds the actuator membrane to the gap standoff layer; and a housing that encases the printhead.

17. The printer claim 16, wherein:

the gap standoff layer comprises a plurality of bonding features, wherein each bonding feature has a first width;

the surface of the actuator membrane comprises a plurality of recesses each having a second width that is wider than the first width;

each bonding feature extends into one of the recesses within the surface of the actuator membrane; and the adhesive is located within the plurality of recesses.

18. The printer of claim 16, wherein:

the gap standoff layer comprises a plurality of bonding features, wherein each bonding feature has a first width;

the surface of the actuator membrane comprises a plurality of recesses each having a second width that is narrower than the first width;

the plurality of recesses overlie one of the bonding features; and the adhesive is located within the plurality of recesses.

19. The printer of claim 18, wherein each of the plurality of recesses, in cross section, comprises a triangular shape.

20. The printer of claim 18, wherein each of the plurality of recesses, in cross section, comprises a square or rectangular shape.

* * * * *